US007147284B2

(12) United States Patent
Mills et al.

(10) Patent No.: US 7,147,284 B2
(45) Date of Patent: Dec. 12, 2006

(54) STUDENT DESK CHAIR WITH ROCKERS RAILS

(75) Inventors: Robert J. Mills, Torrance, CA (US); Peter Glass, Arroyo Grande, CA (US); Scott L. Fletcher, Redondo Beach, CA (US)

(73) Assignee: Virco Mgmt. Corporation, Torrance, CA (US)

( * ) Notice: Subject to any disclaimer, the term of this patent is extended or adjusted under 35 U.S.C. 154(b) by 0 days.

(21) Appl. No.: 10/866,435

(22) Filed: Jun. 10, 2004

(65) Prior Publication Data

US 2005/0275262 A1 Dec. 15, 2005

(51) Int. Cl.
*A47C 3/02* (2006.01)
*A47C 3/021* (2006.01)
*A47C 3/029* (2006.01)

(52) U.S. Cl. ..... 297/271.5; 297/258.1; 297/270.1; 297/270.5; 297/271.6

(58) Field of Classification Search ..... 297/270.1, 297/270.5, 271.5, 271.6, 258.1, 259.2, 261.1, 297/272.1, 272.2
See application file for complete search history.

(56) References Cited

U.S. PATENT DOCUMENTS

| | | | | |
|---|---|---|---|---|
| D8,949 | S | 2/1876 | Sulzbacher | |
| D24,301 | S | 5/1895 | Harden | |
| D39,845 | S | 2/1909 | Killian | |
| D43,442 | S | 1/1913 | Taylor | |
| D48,329 | S | 12/1915 | Severt | |
| D58,118 | S | 6/1921 | Townsend | |
| D68,187 | S | 9/1925 | Wurdack | |
| D99,956 | S | 6/1936 | Morgan | |
| D100,540 | S | 7/1936 | Carlson | |
| D107,271 | S | 11/1937 | Vavrik | |
| D111,200 | S | 9/1938 | Hasenstein | |
| D141,295 | S | 5/1945 | Wright | D15/6 |
| D141,551 | S | 6/1945 | Edelson | D15/1 |
| D150,894 | S | 9/1948 | Smith | D15/6 |
| D166,961 | S | 6/1952 | Giglio | D15/6 |
| D171,209 | S | 12/1953 | Jones | D15/6 |
| D173,881 | S | 1/1955 | Pearl | D15/6 |
| D180,031 | S | 4/1957 | Pearlstine | D15/6 |
| D182,182 | S | 2/1958 | Herschell | D15/6 |
| D194,840 | S | 3/1963 | Ridder et al. | D15/6 |
| D198,312 | S | 6/1964 | Gale | D15/6 |
| D198,625 | S | 7/1964 | Lockshin | D15/6 |
| D207,310 | S | 4/1967 | Caldemeyer et al. | D15/6 |
| D207,311 | S | 4/1967 | Caldemeyer et al. | D15/6 |
| D207,313 | S | 4/1967 | Caldemeyer et al. | D15/6 |
| D207,314 | S | 4/1967 | Caldemeyer et al. | D15/6 |
| D215,930 | S | 11/1969 | Mondragon | D15/6 |
| D225,928 | S | 1/1973 | Lockwood | D6/49 |

(Continued)

OTHER PUBLICATIONS

Rocking Chair Origin, History Design, etc., www.designboom.com, 246 pages.

(Continued)

*Primary Examiner*—Rodney B. White
(74) *Attorney, Agent, or Firm*—Denton L. Anderson; Sheldon Mak Rose & Anderson; Robert M. Hupe

(57) ABSTRACT

A rocking chair particularly suitable for use as a student desk chair as a seating surface, a back rest and a pair of generally parallel rocking rails. Preferably, the rocking chair has a relatively small footprint and has a relatively limited range of rocking motion. In one preferred, but not required embodiment, the pair of generally parallel rocking rails are both reverse cantilevered rocker rails.

18 Claims, 4 Drawing Sheets

U.S. PATENT DOCUMENTS

| | | | | | |
|---|---|---|---|---|---|
| D237,918 | S | | 12/1975 | Chapin et al. | D6/49 |
| D237,919 | S | | 12/1975 | Chapin et al. | D6/49 |
| D239,223 | S | | 3/1976 | Smith | D6/49 |
| D239,794 | S | | 5/1976 | Chapin et al. | D6/49 |
| 4,079,991 | A | * | 3/1978 | Harris | 297/271.6 X |
| D278,283 | S | | 4/1985 | Riart | D6/348 |
| 4,786,105 | A | * | 11/1988 | Sheehan et al. | 297/271.6 |
| D359,169 | S | | 6/1995 | Willens | D6/348 |
| 5,560,675 | A | | 10/1996 | Altheimer et al. | 297/33 |
| 5,599,064 | A | * | 2/1997 | Vanderminden, Sr. | 297/258.1 X |
| 5,695,244 | A | * | 12/1997 | Gillern et al. | 297/271.6 |
| 5,702,152 | A | * | 12/1997 | Shaw | 297/271.6 X |
| D412,406 | S | | 8/1999 | Stumpf et al. | D6/348 |
| 6,604,784 | B1 | * | 8/2003 | Bosman et al. | 297/171 |
| 6,752,458 | B1 | * | 6/2004 | Rivera | 297/258.1 |
| 2003/0209925 | A1 | * | 11/2003 | Bosman et al. | 297/239 |

OTHER PUBLICATIONS

"Tips for Educators Working With Children With Fetal Alcohol Syndrome/Fetal Alcohol Effect", publication date unknown.

"A Note on the Increasing Autism Data", publication date unknown.

"Keys to Success: Combining Communications and Sensory Integration Strategies", publication date unknown.

"Strategies for Classroom Teachers", publication date unknown.

"Hyperactivity: Positive Outlets, not Medication", publication date unknown.

* cited by examiner

STUDENT DESK CHAIR WITH ROCKERS RAILS

FIELD OF THE INVENTION

This invention relates generally to chairs and, more specifically, to rocking chairs.

BACKGROUND OF THE INVENTION

Maintaining the attention span of students, especially young students, in a classroom situation has always been a difficult task. Providing the student with a desk and desk chair which is comfortable and provides good ergonomics throughout the many long hours in a typical school day is increasingly understood to be a critical factor in maintaining the student's attention span.

Also, the dramatic increase in student hours spent in high-intensity computing has created a need for ergonomically sound classroom furniture designed for such activities. Such ergonomically sound classroom furniture tends to prevent distracting discomfort and reduces the risk of injuries associated with long-term exposure to poor ergonomics.

Accordingly, there is a need for a student desk chair which is comfortable throughout the long hours in a typical school day, especially where such long hours may include work at a computer terminal and keyboard.

Such a desk chair must, in addition to being comfortable, must be relatively inexpensive to manufacture, have a relatively small foot print, be easy and safe for ingress and egress and be conveniently storable above the floor (to facility cleaning of the classroom).

SUMMARY

The invention satisfies this need. The invention is a rocking chair and a rocking chair/classroom desk combination. In one embodiment of the invention, the rocking chair comprises: (a) a seating surface; (b) a backrest disposed above the seating surface; and (c) a support carriage comprising a left side reverse cantilevered rocker rail and an opposed right side reverse cantilevered rocker rail, both rocker rails being disposed generally parallel to the longitudinal axis of the seating surface, the support carriage being adapted to support the seating surface above the floor.

In another embodiment, the rocking chair comprises: (a) a seating surface having a horizontal longitudinal axis, a forward edge which terminates at a vertical forward edge seating surface plane disposed generally perpendicular to the longitudinal axis of the seating surface, a left side edge which terminates at a vertical left side seating surface plane disposed generally parallel with the longitudinal axis of the seating surface and a right side edge which terminates at a vertical right side seating surface plane disposed generally parallel with the longitudinal axis of the seating surface; (b) a backrest disposed above the seating surface, the backrest having an upper edge which terminates at a vertical backrest plane disposed generally perpendicular to the longitudinal axis of the seating surface; and (c) a support carriage having a left side rocker rail and an opposed right side rocker rail, the support carriage being adapted to support the seating surface at an elevation above a floor, the pair of rocker rails being generally parallel to the longitudinal axis of the seating surface, each rocker rail having a forward most portion, a rearward most portion and a central portion, the forward most portion extending forwardly no more than about 3 inches beyond the forward edge seating surface plane, the rearward most portion extending rearwardly no more than about 1 inch beyond the backrest plane, the left side rocker rail extending laterally no more than about 1 inch beyond the left side seating surface plane and the right side rocker rail extending laterally no more than about 1 inch beyond the right side seating surface plane, the central portions of both rocker rails being at least about 20 inches in length and having lower surfaces with identical curvatures, both curvatures having one or more degrees of curvature, none of which is greater than about 70 degrees.

DRAWINGS

These and other features, aspects and advantages of the present invention will become better understood with reference to the following description, appended claims and accompanying drawings where:

DETAILED DESCRIPTION

Figures 1, 2:
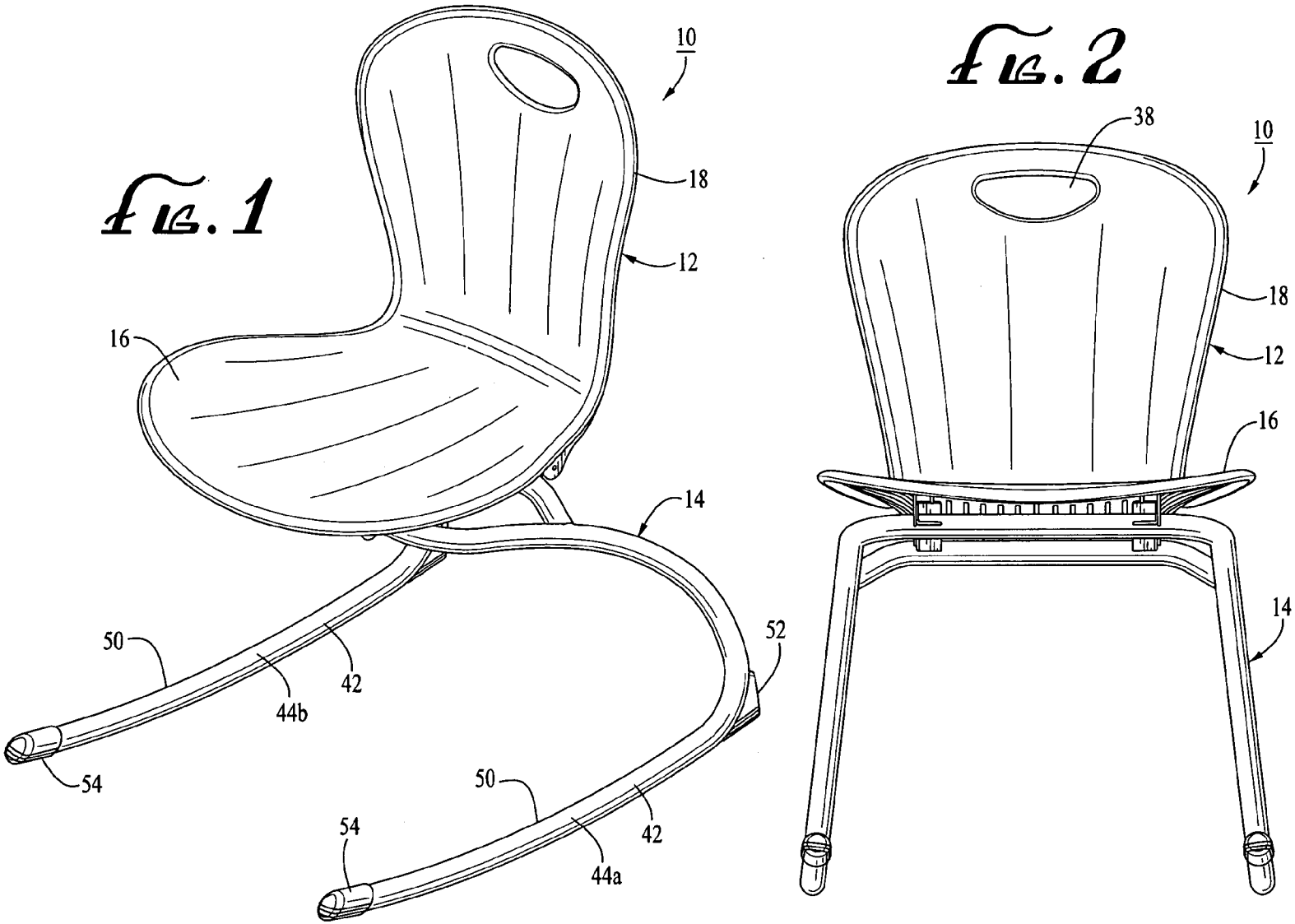
FIG. 1 is a perspective view of a rocking chair having features of the invention.
FIG. 2 is a front view of the rocking chair illustrated in FIG. 1.
Figure 4:
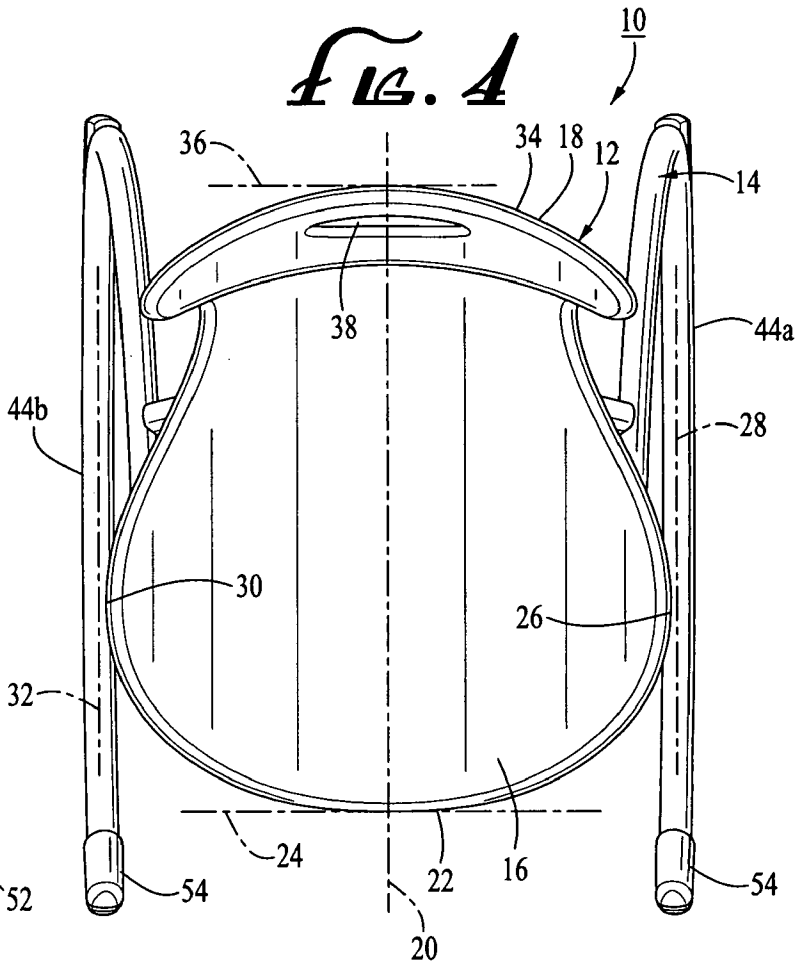
FIG. 4 is a top view of the rocking chair illustrated in FIG. 1.
Figure 3:
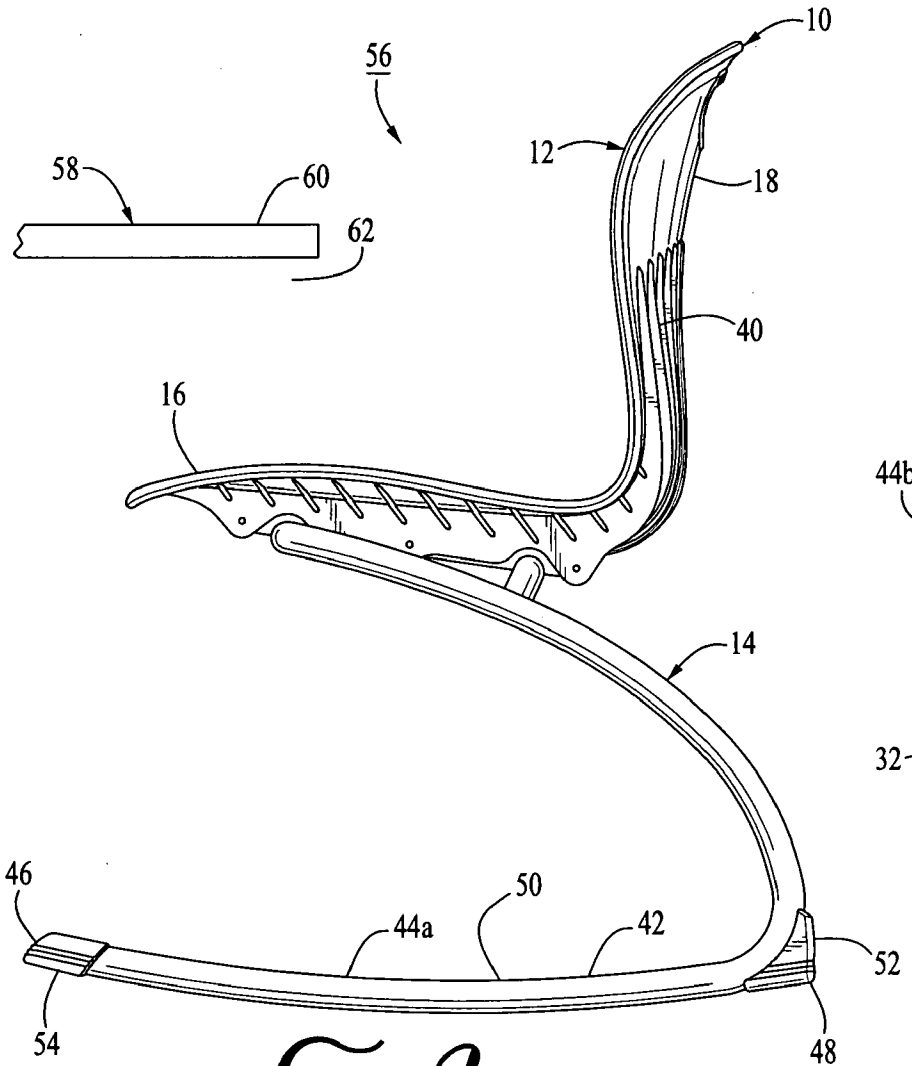
FIG. 3 is a side view of a classroom chair and desk combination having features of the invention, including a side view of the rocking chair illustrated in FIG. 1.
Figure 6:
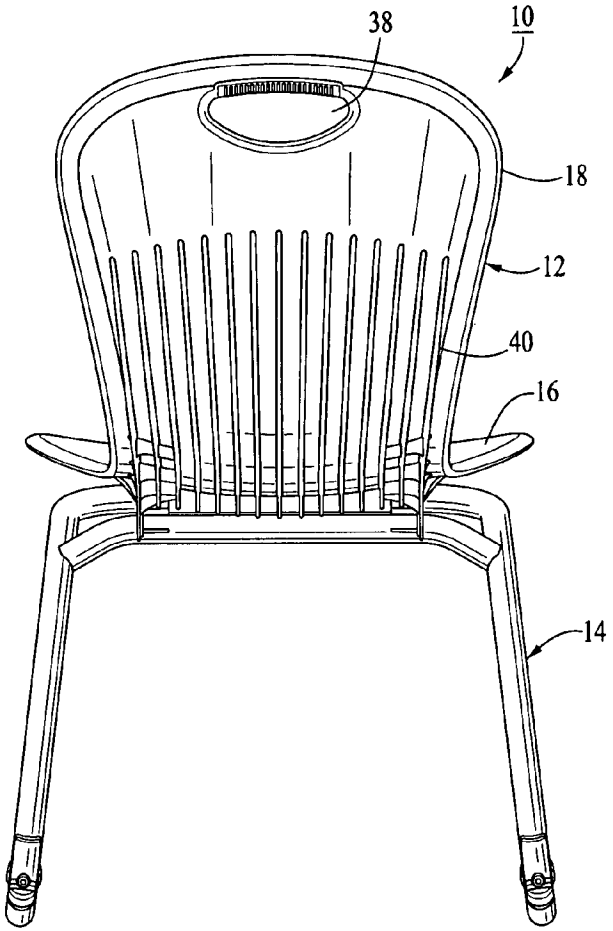
FIG. 6 is a rear view of the rocking chair illustrated in FIG. 1.
Figure 5:
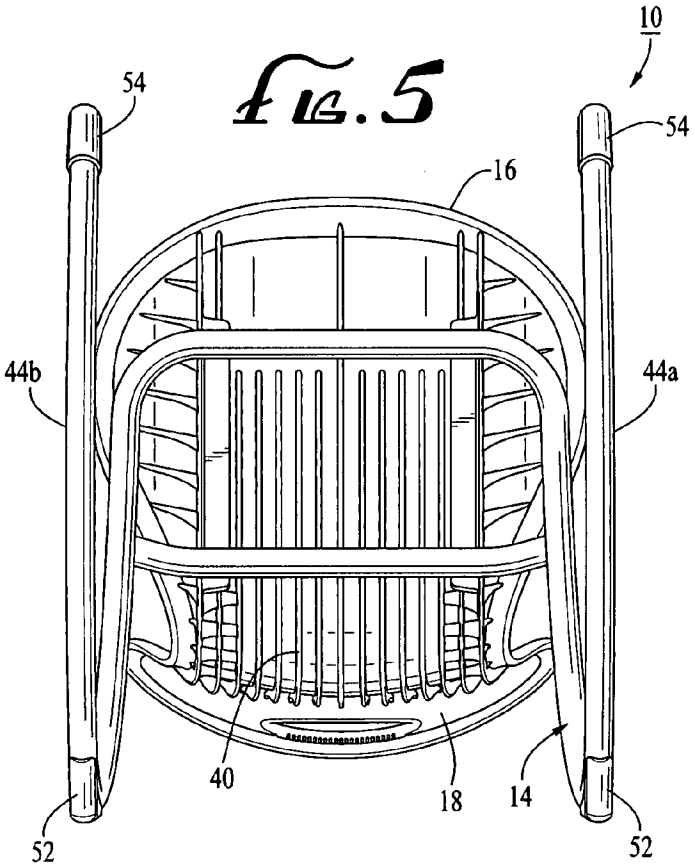
FIG. 5 is a bottom view of the rocking chair illustrated in FIG. 1.
Figure 7:
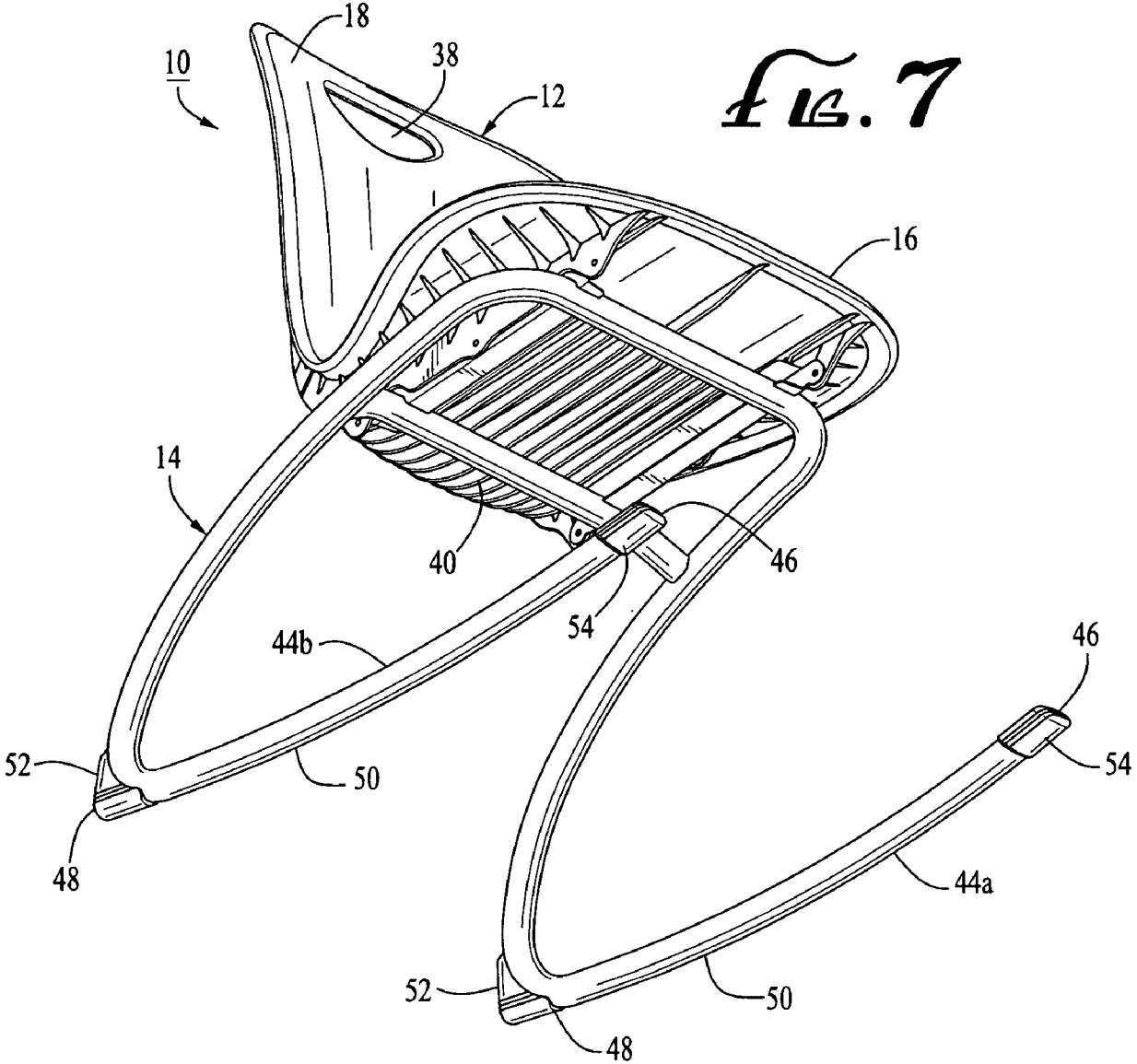
FIG. 7 is a second perspective view of the rocking chair illustrated in FIG. 1, showing the underside of the rocking chair.

The following discussion describes in detail one embodiment of the invention and several variations of that embodiment. This discussion should not be construed, however, as limiting the invention to those particular embodiments. Practitioners skilled in the art will recognize numerous other embodiments as well.

The invention is a rocking chair 10 having unique characteristics which make it suitable as a classroom chair.

As illustrated in the drawings, a typical rocking chair 10 of the invention comprises a seating assembly 12 mounted on a support carriage 14. The seating assembly 12 comprises a generally horizontal seating surface 16 and a generally vertical backrest 18 disposed above the seating surface 16. The seating assembly 12 is preferably contoured to conform to the body of the user for whom the rocking chair 10 is designed.

The seating assembly 12 can be made from a variety of materials, including metals, woods and plastics. Plastic materials, such as polypropylene, have been found to be suitable for use in the seating assembly 12.

The seating surface 16 has a horizontal longitudinal axis 20 and a forward edge 22 which terminates at a vertical forward edge seating surface plane 24 which is disposed generally perpendicular to the longitudinal axis 20 of the seating surface 16. The seating surface 16 further comprises (i) a left side edge 26 which terminates at a vertical left side seating surface plane 28 which is generally parallel to the longitudinal axis 20 of the seating surface 16 and (ii) a right side edge 30 which terminates at a vertical right side seating surface plane 32 which is generally parallel to the longitudinal axis 20 of the seating surface 16.

The backrest 18 has an upper edge 34 which terminates at a vertical backrest plane 36 which is disposed generally perpendicular to the longitudinal axis 20 of the seating surface 16. An aperture 38 can be provided in the backrest 18 to provide a hand-hold for the convenient lifting of the rocking chair 10.

In the embodiment illustrated in the drawings, a plurality of parallel reenforcing ribs 40 are provided on both the rear side of the backrest 18 and the underside of the seating surface 16 to provide additional rigidity.

The seating assembly 12 can be provided in a plurality of assembled parts or, as illustrated in the drawings, as an integral unit.

The seating assembly 12 is attached to the support carriage 14 such that the seating surface 16 is supported at an appropriate height above a floor. The support carriage 14 can have any number of configurations. In the embodiment illustrated in the drawings, the support carriage 14 is comprised of rolled steel tubing.

The support carriage 14 comprises a pair of opposed generally parallel rocker rails 42. Preferably, as illustrated in the drawings, the rocker rails 42 comprise a left side reverse cantilevered rocker rail 44*a* and an opposed right side reversed cantilevered rocker rail 44*b*. The use of cantilevered rocker rails 42 provide the support carriage 14 with a degree of flexure not found where the rocker rails 42 are supported by linear struts.

The use of reverse cantilevered rocker rails 42 provides additional advantages over conventional cantilevered rocker rails 42. The forwardmost portions 46 of the rocker rails 42 in embodiments having reversed cantilevered rocker rails 42 do not protrude as far forward and are not disposed as far above the floor as are the forwardmost portions 46 of the cantilevered rocker rails 42 which are not reversed in design. Accordingly, the use of reverse cantilevered rocker rails 42 facilitate the safe and easy ingress and egress by the user and facilitate the construction of a classroom rocking chair 10 having a reduced footprint.

Rocking chairs 10 having minimized footprints are very important in classroom situations to efficiently make use of the limited space available within the classroom and to safely and efficiently retain a large number of students within the classroom. A smaller foot print also reduces the risk of tripping over the rocker rails 42. Thus, it is preferably that the forwardmost portion 46 extends forwardly no more than about 3 inches beyond the forward edge seating surface plane 24, the rearwardmost portion 48 extends rearwardly no more than about 1 inch beyond the backrest plane 36, the left side rocker cantilevered rocker rail 44*a* extends laterally no more than about 1 inch beyond the left side seating surface plane 28 and the right side reverse cantilevered rocker rail 44*b* extends laterally no more than about 1 inch beyond the right side seating surface plane 32.

An additional advantage of using reverse cantilevered rocker rails 42 is that the use of reverse cantilevered rocker rails 42 encourages both relaxed and attentive seating. All rocker rails 42 allow the user to lean back, tipping the seat angle rearward into a relaxed position. Traditional cantilevered rocker rails 42 allow the rocking chairs 10 to emphasize this because their frame-flex naturally rotates the seating surface 16 further back. However, with reverse cantilevered rocker rails 42, the seating surface 16 angle tends to tip forward during the front portion of the rocker rails' travel (as the backrest 18 flexes into a more closed position), particularly when the user's weight and sitting position shifts slightly forward on the seating surface 16 (as when the user is operating a keyboard) which allows better back support, permits the pelvis to rotate forward for better ergonomics and comfort during focused work (by encouraging proper reversed curvature of the lumbar spine) and opens up the leg-body angle for better blood flow to the legs and feet.

The use of reverse cantilevered rocker rails 42 also provides the advantage of allowing the rocking chair 10 to be simply and easily stored above the floor (such as for cleaning the floor) by resting the underside of the seating surface 16 on the top of the desk 58 while sliding the rocker rails 42 immediately below the desktop.

The support carriage 14 and the rocker rails 42 are configured and constructed of materials so that the amount of spring in the support carriage 14 when in use by a user is not excessive and is not too stiff. In one embodiment, the rocker rails 42 are made of 12-gage (0.1046) steel tube with a nominal 1-inch outside diameter.

The rocker rails 42 each have a forwardmost portion 46, a rearwardmost portion 48 and a central portion 50. Typically, the central portion 50 of both rocker rails 42 is at least about 20 inches in length and have lower surfaces with identical curvatures. Typically, the curvature of both rocker rails 42 have a single degree of curvature between about 50 degrees and about 70 degrees, preferably between about 55 degrees and about 65 degrees. In one embodiment, the radius of the two rocker rails 42 is 60.17 degrees.

Preferably, the forward motion of the rocking chair 10 and the rearward motion of the rocking chair 10 are carefully controlled so as to provide sufficient forward and rearward motion, while preventing excessive forward and rearward motion. In the embodiment illustrated in the drawings, the furthest forward motion of the rocking chair 10 is about 8.5 degrees from its at-rest position. The furthest rearward motion of the rocking chair 10 is about 7 degrees from the at-rest position.

Typically, the rearwardmost portion 48 of both rocker rails 42 comprises a rocker stop 52 to effectively prevent rearward rocking motion of the rocking chair 10. The rocker stop can be made from a resilient material.

Typically, the forwardmost portions 46 of both rockers 10 are covered with a cap 54 made of a resilient material.

The invention is also a classroom desk and chair combination 56 comprising (i) a student desk 58 having an elevated, generally horizontal work surface 60 and an open space 62 defined below the work surface 60 and (ii) a rocking chair 10 as described above. Typically, the work surface 60 defines a work surface area of at least about 50 square inches, most typically of at least about 225 square inches, such as between about 500 square inches and about 1000 square inches. In the desk and chair combination 56, the rocking chair 10 is sized and dimensioned to allow the forward portion of the rocking chair 10 to be positioned within the open space 62 below the work surface 60. The work surface 60 is disposed at an elevation between about 10 inches and about 15 inches above the elevation of the seating surface 16 of the rocking chair 10. Such a design of a classroom desk and chair combination 56 allow a student to comfortably sit within the rocking chair 10 and work at the work surface 60. Such desk and chair combination 56 are especially suited for comfortably retaining students within a classroom situation for many hours at a time, even where the students are working at computer terminals disposed on top of the work surfaces 60, for example, laptop computer terminals placed upon the work surfaces 60.

The rocking chair 10 of the invention provides both good ergonomics and comfort in a product that is also attractive and fun to use. Such a rocking chair 10 will provide students with positive feelings about their school and about their classroom environment. Such positive feelings are recognized by educators to be critical factors in the improvement of a student's academic performance.

Having thus described the invention, it should be apparent that numerous structural modifications and adaptations may be resorted to without departing from the scope and fair meaning of the instant invention as set forth hereinabove.

What is claimed is:

1. A rocking chair comprising:

(a) a seating surface having a right side, a left side, a forward portion, and a rearward portion, the seating surface being adapted to support a user thereon;

(b) a backrest disposed above the seating surface;

(c) a forward flexing support carriage disposed below the seating surface and adapted to support the seating surface above a floor, the support carriage comprising:

(i) a left side rocker rail having a forward portion and a rearward portion;

(ii) an opposed right side rocker rail having a forward portion and a rearward portion;

(iii) a left side support extending downward from the rearward portion of the left side of the seating surface to the rearward portion of the left side rocker rail; and (iv) a right side support extending downward from the rearward portion of the right side of the seating surface to the rearward portion of the right side rocker rail, wherein both rocker rails are disposed generally parallel to a longitudinal axis of the seating surface, and wherein the seating surface is cantilevered by the left side support and the right side support of the support carriage, the support carriage providing forward flexure of the rocking chair and allowing the seating surface to tip forwardly.

2. The rocking chair of claim 1 wherein:

(a) the seating surface has a horizontal longitudinal axis, a forward edge which terminates at a vertical forward edge seating surface plane disposed generally perpendicular to the longitudinal axis of the seating surface, a left side edge which terminates at a vertical left side seating surface plane disposed generally parallel with the longitudinal axis of the seating surface and a right side edge which terminates at a vertical fight side seating surface plane disposed generally parallel with the longitudinal axis of the seating surface;

(b) the backrest has an upper edge which terminates at a vertical backrest plane disposed generally perpendicular to the longitudinal axis of the seating surface; and (c) each rocker rail has a forwardmost portion, a rearwardmost portion and a central portion, the forwardmost portion extending forwardly no more than about 3 inches beyond the forward edge seating surface plane, the rearwardmost portion extending rearwardly no more than about 1 inch inches beyond the backrest plane, the left side rocker rail extending laterally no more than about 1 inch beyond the left side seating surface plane and the right side rocker rail extending laterally no more than about 1 inch beyond the right side seating surface plane.

3. The rocking chair of claim 1 wherein each rocker rail has a forwardmost portion, a rearwardmost portion and a central portion, the central portions of both rocker rails being at least about 20 inches in length and having lower surfaces with identical curvatures, both curvatures having a radius of curvature which is greater than 70 degrees.

4. The rocking chair of claim 1 wherein each rocker rail has a forwardmost portion, a rearwardmost portion and a central portion, the central portions of both rocker rails being at least about 20 inches in length and having lower surfaces with identical curvatures, both curvatures having a radius of curvature between about 55 degrees and about 70 degrees.

5. The rocking chair of claim 1 wherein:

(a) the seating surface has a horizontal longitudinal axis, a forward edge which terminates at a vertical forward edge seating surface plane disposed generally perpendicular to the longitudinal axis of the seating surface, a left side edge which terminates at a vertical left side seating surface plane disposed generally parallel with the longitudinal axis of the seating surface and a right side edge which terminates at a vertical right side seating surface plane disposed generally parallel with the longitudinal axis of the seating surface;

(b) the backrest has an upper edge which terminates at a vertical backrest plane disposed generally perpendicular to the longitudinal axis of the seating surface; and (c) each rocker rail has a forwardmost portion, a rearwardmost portion and a central portion, the forwardmost portion extending forwardly no more than about 3 inches beyond the forward edge seating surface plane, the rearwardmost portion extending rearwardly no more than about 1 inch inches beyond the backrest plane, the left side rocker rail extending laterally no more than about 1 inch beyond the left side seating surface plane and the right side rocker rail extending laterally no more than about 1 inch beyond the right side seating surface plane, the central portions of both rocker rails being at least 20 inches in length and having lower surfaces with identical curvatures, both curvatures having a radius of curvature which is greater than 70 degrees.

6. The rocking chair of claim 1 wherein the rocker rails are made from 1-inch tubular steel.

7. A classroom desk and chair combination comprising:

(a) a student desk having (i) an elevated, generally horizontal work surface and (ii) an open space defined below the work surface; and (b) the rocking chair defined in claim 1;

wherein the rocking chair is sized and dimensioned to allow the forward edge of the rocking chair to be positioned within the open space below the work surface; and wherein the work surface is disposed at an elevation between about 10 inches and about 15 inches above the elevation of the seating surface of the rocking chair;

so that a student can comfortably sit within the rocking chair and work at the work surface.

8. The classroom desk and chair combination of claim 7 wherein:

(a) the seating surface has a horizontal longitudinal axis, a forward edge which terminates at a vertical forward edge seating surface plane disposed generally perpendicular to the longitudinal axis of the seating surface, a left side edge which terminates at a vertical left side seating surface plane disposed generally parallel with the longitudinal axis of the seating surface and a right side edge which terminates at a vertical fight side seating surface plane disposed generally parallel with the longitudinal axis of the seating surface;

(b) the backrest has an upper edge which terminates at a vertical backrest plane disposed generally perpendicular to the longitudinal axis of the seating surface; and (c) each rocker rail has a forwardmost portion, a rearwardmost portion and a central portion, the forwardmost portion extending forwardly no more than about 3 inches beyond the forward edge seating surface plane, the rearwardmost portion extending rearwardly no more than about 1 inch inches beyond the backrest plane, the left side rocker rail extending laterally no more than about 1 inch beyond the left side seating surface plane and the right side rocker rail extending laterally no more than about 1 inch beyond the right side seating surface plane.

9. The classroom desk and chair combination of claim 7 wherein each rocker rail has a forwardmost portion, a rearwardmost portion and a central portion, the central portions of both rocker rails being at least about 20 inches in length and having lower surfaces with identical curvatures, both curvatures having a radius of curvature which is greater than 70 degrees.

10. The classroom desk and chair combination of claim 7 wherein each rocker rail has a forwardmost portion, a rearwardmost portion and a central portion, the central portions of both rocker rails being at least about 20 inches in length and having lower surfaces with identical curvatures, both curvatures having a radius of curvature between about 55 degrees and about 70 degrees.

11. The classroom desk and chair combination of claim 7 wherein:

(a) the seating surface has a horizontal longitudinal axis, a forward edge which terminates at a vertical forward edge seating surface plane disposed generally perpendicular to the longitudinal axis of the seating surface, a left side edge which terminates at a vertical left side seating surface plane disposed generally parallel with the longitudinal axis of the seating surface and a right side edge which terminates at a vertical fight side seating surface plane disposed generally parallel with the longitudinal axis of the seating surface;

(b) the backrest has an upper edge which terminates at a vertical backrest plane disposed generally perpendicular to the longitudinal axis of the seating surface; and (c) each rocker rail has a forwardmost portion, a rearwardmost portion and a central portion, the forwardmost portion extending forwardly no more than about 3 inches beyond the forward edge seating surface plane, the rearwardmost portion extending rearwardly no more than about 1 inch inches beyond the backrest plane, the left side rocker rail extending laterally no more than about 1 inch beyond the left side seating surface plane and the right side rocker rail extending laterally no more than about 1 inch beyond the right side seating surface plane, the central portions of both rocker rails being at least 20 inches in length and having lower surfaces with identical curvatures, both curvatures having a radius of curvature which is greater than 70 degrees.

12. The classroom desk and chair combination of claim 7 wherein the rocker rails are made from 1-inch tubular steel.

13. A rocking chair comprising:

(a) a seating surface having a horizontal longitudinal axis, a forward edge which terminates at a vertical forward edge seating surface plane disposed generally perpendicular to a longitudinal axis of the seating surface, a left side edge which terminates at a vertical left side seating surface plane disposed generally parallel with the longitudinal axis of the seating surface and a right side edge which terminates at a vertical right side seating surface plane disposed generally parallel with the longitudinal axis of the seating surface;

(b) a backrest disposed above the seating surface, the backrest having an upper edge which terminates at a vertical backrest plane disposed generally perpendicular to the longitudinal axis of the seating surface; and (c) a forward flexing support carriage disposed below the seating surface and adapted to support the seating surface above a floor, the support carriage comprising:

(i) a left side rocker rail having a forward portion and a rearward portion;

(ii) an opposed right side rocker rail having a forward portion and a rearward portion;

(iii) a left side support extending downward from the rearward portion of the left side of the seating surface to the rearward portion of the left side rocker rail; and (iv) a right side support extending downward from the rearward portion of the right side of the seating surface to the rearward portion of the right side rocker rail, wherein both rocker rails are disposed below the seating surface and are adapted to support the seating surface at an elevation above a floor, the pair of rocker rails being generally parallel to the longitudinal axis of the seating surface, each rocker rail having a forwardmost portion, a rearwardmost portion and a central portion, the forwardmost portion extending forwardly no more than about 3 inches beyond the forward edge seating surface plane, the rearwardmost portion extending rearwardly no more than about 1 inch inches beyond the backrest plane, the left side rocker rail extending laterally no more than about 1 inch beyond the left side seating surface plane and the right side rocker rail extending laterally no more than about 1 inch beyond the right side seating surface plane, the central portions of both rocker rails being at least about 20 inches in length and having lower surfaces with identical curvatures, both curvatures having one or more degrees of curvature, none of which is great than about 70 degrees, wherein the seating surface is cantilevered by the left side support and the right side support of the support carriage, the support carriage providing forward flexure of the rocking chair and allowing the seating surface to tip forwardly.

14. The rocking chair of claim 13 wherein the left side rocker rail and the right side rocker rail are both cantilevered rocker rails.

15. The rocking chair of claim 13 wherein the rocker rails are made from 1-inch tubular steel.

16. A classroom desk and chair combination comprising:

(a) a student desk having (i) an elevated, generally horizontal work surface and (ii) an open space defined below the work surface; and (b) the rocking chair defined in claim 13;

wherein the rocking chair is sized and dimensioned to allow the forward edge of the rocking chair to be positioned within the open space below the work surface; and wherein the work surface is disposed at an elevation between about 10 inches and about 15 inches above the elevation of the seating surface of the rocking chair;

so that a student can comfortably sit within the rocking chair and work at the work surface.

17. The classroom desk and chair combination of claim 16 wherein the left side rocker rail and the right side rocker rail are both cantilevered rocker rails.

18. A classroom desk and chair combination comprising:

(a) a student desk having (i) an elevated, generally horizontal work surface and (ii) an open space defined below the work surface; and (b) the rocking chair defined in claim 1;

wherein the rocking chair is sized and dimensioned to allow the forward edge of the rocking chair to be positioned within the open space below the work surface.

* * * * *